United States Patent [19]

Baumann

[11] Patent Number: 4,981,421

[45] Date of Patent: Jan. 1, 1991

[54] VALVE ARRANGEMENT

[75] Inventor: Heinz Baumann, Winterthur, Switzerland

[73] Assignee: Sulzer Brothers Limited, Winterthur, Switzerland

[21] Appl. No.: 453,417

[22] Filed: Dec. 19, 1989

Related U.S. Application Data

[62] Division of Ser. No. 363,632, Jun. 8, 1989, Pat. No. 4,936,327.

[30] Foreign Application Priority Data

Jun. 9, 1988 [CH] Switzerland ..... 02209/88

[51] Int. Cl.[5] ..... F16K 15/02; F04C 29/08

[52] U.S. Cl. ..... 417/571; 137/888

[58] Field of Search ..... 417/563, 564, 566, 571; 137/888.022

[56] References Cited

U.S. PATENT DOCUMENTS

| | | | |
|---|---|---|---|
| 1,998,444 | 4/1935 | Clapp | 137/543.19 |
| 2,155,236 | 4/1939 | Newell | 417/563 |
| 2,754,844 | 7/1956 | Blackford | 137/543.19 |
| 2,792,790 | 5/1957 | Capps | 417/566 |
| 2,800,142 | 7/1957 | Champion | 137/543.19 |
| 3,664,371 | 5/1972 | Schneider | 137/543.19 |
| 3,911,502 | 10/1975 | Boretos | 137/533.11 |
| 4,368,755 | 1/1983 | King | 137/512.3 |
| 4,428,464 | 1/1984 | Miura | 137/543.19 |
| 4,543,989 | 10/1985 | Lorson | 137/543.19 |

FOREIGN PATENT DOCUMENTS

| | | |
|---|---|---|
| 427276 | 9/1934 | United Kingdom . |
| 1530582 | 11/1978 | United Kingdom . |
| 2109094 | 5/1983 | United Kingdom . |

*Primary Examiner*—Leonard E. Smith
*Assistant Examiner*—David L. Cavanaugh
*Attorney, Agent, or Firm*—Kenyon & Kenyon

[57] ABSTRACT

The valve arrangement comprises a disc engageable with a valve seat without attachment and a resilient diaphragm engageable with the disc without attachment. The disc completely covers a passage surrounded by the valve seat and flowed through by a fluid. On the side remote from the valve seat, the disc has a central protuberance with cooperates with a central thrust surface of the diaphragm. The disc and the diaphragm are freely movable in a recess adapted to be flowed through by the fluid, the recess being present in a guide member extending around the valve seat. The recess has an inwardly projecting step with which the diaphragm edge part is urged into engagement. This arrangement leads to a flat compact valve with minimum dead space.

6 Claims, 2 Drawing Sheets

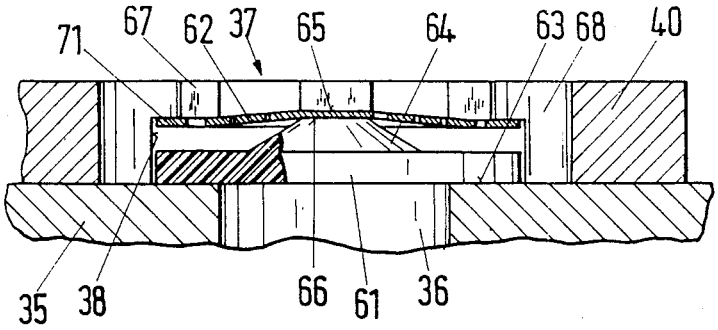
Fig. 2
Fig. 3
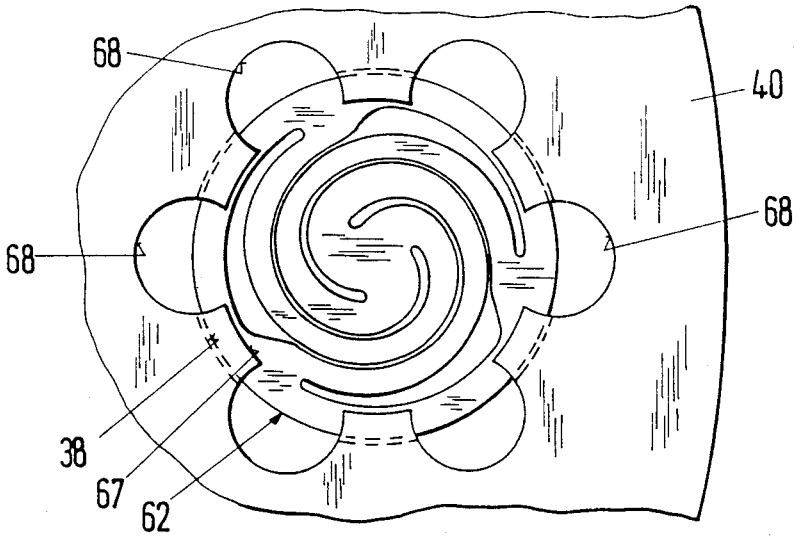
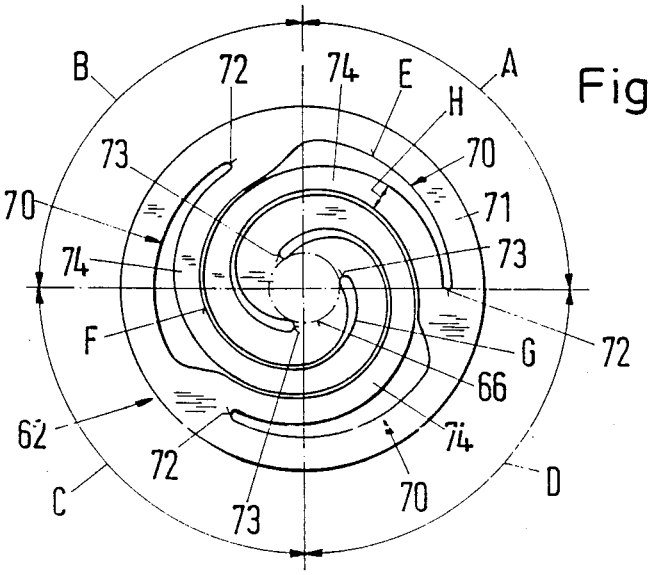
Fig. 4

VALVE ARRANGEMENT

This is a division of application Ser. No. 363,632 filed June 8, 1989, now U.S. Pat. No. 4,936,327 issued June 26, 1990.

This invention relates to a valve arrangement. More particularly, this invention relates to a valve arrangement for reciprocating compressors, pumps and conduits.

Conventional valve arrangements, for example, for compressors generally have a valve plate which is formed with annular or concentric slots and which is clamped together with a resilient diaphragm by a central screw or, for example, by three corresponding securing elements distributed over the valve between a valve seat part adapted to be placed on a flow passage and a retaining plate clampable to the valve seat part, the latter part and the plate being formed with orifices adapted to be flowed through by a fluid.

However, these known multipart valve constructions are relatively bulky and require a relatively substantial amount of labor for their assembly and for fitting the valve.

U.K. Pat. Application 2,109,094 describes a discharge valve assembly which is to be secured in overlying relationship to a cylinder of a reciprocating piston compressor. The valve plate assembly includes a lower valve plate, a center plate and an upper valve plate as well as a ring type suction valve in which a valve member is biased by a leaf spring into engagement with a valve seat. Such a construction is rather cumbersome and requires a substantial amount of space relative to the cylinder of the compressor.

British Pat. No. 427,276 describes a compressor valve structure which employs a valve assembly which cooperates with a leaf type spring. However, the overall construction is rather cumbersome.

British Pat. No. 1,530,582 describes a valve arrangement employing a spring for biasing a flat plate against a valve seat. However, such a construction requires a relatively large amount of space to accommodate the contour of the spring. Likewise, U.S. Pat. No. 4,368,755 describes a valve assembly which employs a spring for biasing a valve member into sealing with a valve seat. However, a relatively large amount of space is required for such a construction.

Accordingly, it is an object of the invention to provide a simplified compact and low cost valve arrangement.

It is another object of the invention to provide a valve arrangement which can ba readily assembled and fitted into a compressor.

It is another object of the invention to reduce the dead space within a valve arrangement.

It is another object of the invention to reduce the space occupied by a valve arrangement in a reciprocating compressor.

It is another object of the invention to simplify the construction of a valve arrangement for mounting in compressors, pumps and conduits.

Briefly, the invention provides a valve arrangement which is comprised of a body having a flow passage and a valve seat at one end of the passage and a guide part mounted on the body with a recess facing the flow passage and with a second flow passage extending from the recess. In addition, the valve arrangement includes a disc which is mounted in the recess of the guide part and which abuts against the valve seat to extend across the flow passage in the body as well as a round resilient diaphragm peripherally mounted on the guide part within the recess.

The disc is provided with a centrally disposed protuberance defining an abutment surface on a side opposite the body while the diaphragm has a central thrust surface abutting the abutment surface of the protuberance. In addition, the central thrust surface is resiliently biased against the protuberance to resiliently maintain the disc in sealed relation with the valve seat In this respect, the central thrust surface of the diaphragm is resiliently deflected in a direction away from the disc to resiliently maintain the disc in sealed relation with the valve seat.

The disc of the valve arrangement is adapted to engage the valve seat without attachment Likewise, the diaphragm is engaged with the protuberance of the disc without attachment. Both the disc and the diaphragm are disposed for free movement in the recess of the guide part, at least to some extent, to permit the disc to move from the valve seat for the passage of a flow of medium thereby. Since there are no securing members, the overall valve arrangement can be made of a very flat construction with an overall height determined substantially only by the thickness of the disc and the diaphragm and by the stroke of the disc. The fitting and demounting of the disc and diaphragm are also simplified.

The valve arrangement can be readily employed in a reciprocating compressor. For example, where the compressor has a cylinder and a piston slidably mounted in the cylinder to define a compression chamber, the valve arrangement may be used as an inlet valve communicating with the compression chamber to deliver a flow of medium thereto for compression therein. Likewise, the valve arrangement can be used as an outlet valve communicating with the compression chamber to exhaust a compressed flow of medium therefrom.

These and other objects and advantages of the invention will become more apparent from the following detailed description taken in conjunction with the accompanying drawings wherein:

FIG. 2 illustrates a cross sectional view of a valve arrangement constructed in accordance with the invention;

FIG. 3 illustrates a plan view of the valve arrangement of FIG. 2; and

FIG. 4 illustrates a plan view of a diaphragm used in the valve arrangement in accordance with the invention;

Figure 1:
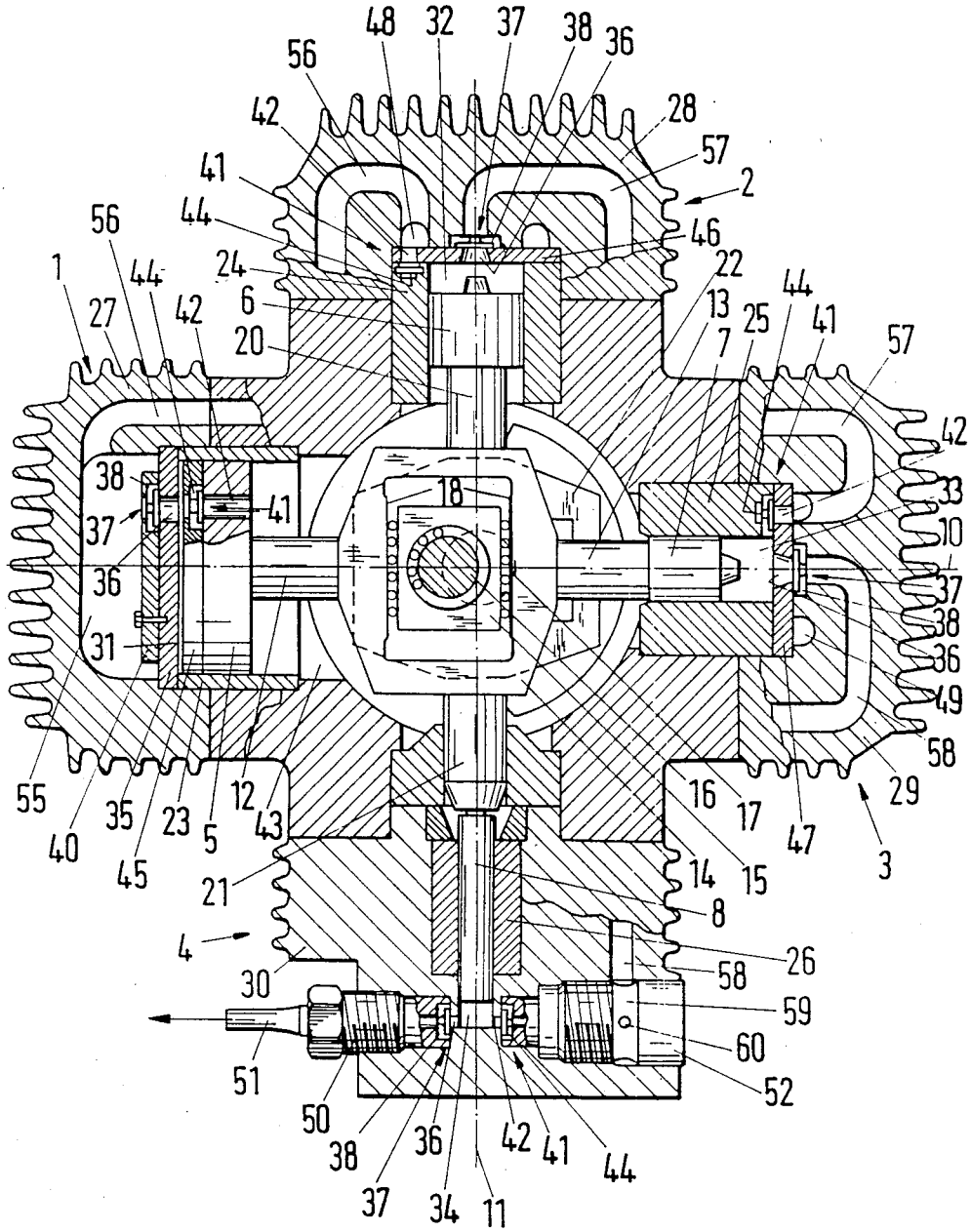
FIG. 1 illustrates a cross-sectional view through two horizontal planes of a reciprocating compressor having valve arrangements in accordance with the invention.

Referring to FIG. 1, the reciprocating compressor is constructed with four cylinders 1–4 in which pistons 5–8 are slidably mounted to define compression chambers therewith. As indicated, two of the cylinders 1, 3 have a common axis 10 in the plane of the drawing while the other cylinders 2, 4 are disposed on a common axis 11 set back from the plane of the drawing. The pistons 5, 7 are coupled, by way of a yoke 14 interconnecting their respective piston rods 12, 13, to a slide block 15 mounted on as crank pin 16 of a crank shaft 17. The shaft 17 is connected to a motor (not shown), for example, an electric motor. The slide block 15 is guided for movement transverse to the axis 11 between two guides 18 devised in the yoke 14. The pistons 6, 8 are coupled, by way of a yoke 22 interconnecting their respective piston rods 20, 21, to a second slide block (not shown) which is mounted on the crank pin 16 and which is guided for movement transverse to the axis 11 in the yoke 22, which is offset by 90° from the yoke 14.

The pistons 5–8, which are guided in cylinder liners 23–26, respectively, each bound a respective compression chamber 31–34 in the cylinders 1–4 the same being closed by releaseably secured cylinder covers or heads 27–30, respectively.

The compression chamber 31 of the cylinder 1, which is effective as a first compression stage, is bounded by an end plate 35 which is inserted in the cylinder head 27 and which is formed with a number of passages 36 (for example, four passages) offset from another in the peripheral direction. Each passage 36, only one of which can be seen in FIG. 1, is associated with an outlet valve 37. The outlet valves 37 are each disposed on that side of the end plate 35 which is remote from the piston 5 in a recess 38 in a guide member in the form of a retaining plate 40 releaseably secured to the end plate 35.

The piston 5 is also formed with a number of passages 42 each of which is associated with an inlet valve 41.

Correspondingly, on each inlet stroke of the piston 5 and with the inlet valves 41 open, a communication is established between the compression chamber 31 and a cylinder chamber 43 separated therefrom by the piston 5, the cylinder chamber 43 being connected to a feed line (not shown) for the medium to be compressed, for example, natural gas. On that side of the piston 5 which is near the compression chamber 31, the inlet valves 41 are each disposed in a recess 44 in another guide member in the form of a retaining plate 45 which is releaseably secured to the piston 5.

The compression chamber 32, 33 in the cylinders 2, 3 are each bounded by a respective end plate 46, 47 disposed on the respective liner 24, 25. Each end plate 46, 47 is formed with a central passage 36, each having an outlet valve 37, and a number of passages 42 (for example, four) which have inlet valves 41 and are offset from one another in the peripheral direction and only one of which can be seen in FIG. 1. The recess 38 receiving the outlet valve 37 is disposed in the respective cylinder head 28, 29. The recesses 44 receiving the inlet valves 41 are present in that end part of the respective liner 24, 25 which is near the respective end plate 46, 47, such end part being effective as a guide member for the inlet valves 41. Each recess 38 communicates by way of a lateral orifice with the respective compression chamber 32, 33.

The cylinder 4 is formed with a passage having an outlet valve 37 and the cylinder head 30 is formed with a passage 42 having the inlet valve 41. The recess 38 which receives the outlet valve 37 is disposed in a nipple 50, adapted to be screwed into the cylinder head 30, of a delivery line 51 which extends away from the compressor while the recess 44 which receives the inlet valve 41 is disposed in a nipple 52 which connects the compression chamber 34 to a flow passage 58 in the cylinder head 30.

The piston 5 is shown in FIG. 1 in a top dead center position in which the compression chamber 31 is at the smallest During the inlet stroke of the piston 5, the gas fed to the cylinder chamber 43 is intaken through the passage 42 with the inlet valve 41 open. During the delivery stroke, the gas, compressed to a pressure of, for example, 5 bar, is fed, with the outlet valve 37 open, through passage 36 into a cylinder chamber 55 and therefrom, by way of a flow duct 56 interconnecting the cylinder heads 27 and 28 and of an annular passage 48, to the second compression stage embodied by the cylinder 2.

The gas intaken through the passages 42 into the compression chamber 32 on the inlet stroke of the second-stage piston 6 is compressed to a pressure of, for example, 20 bar at the next delivery stroke and, with the outlet valve 37 open, is supplied, by way of a flow passage 57 interconnecting the cylinder heads 28 and 29 and cf an annular passage 49, to the third compression stage embodied by the cylinder 3.

FIG. 1 shows the piston 7 of the cylinder 3 in a bottom dead center position in which the compression chamber 33 is at the largest. The gas intaken thereinto on the intake stroke of the piston 7 is compressed to a pressure of, for example, 60 bar on the next delivery stroke and supplied, by way of the flow passage 58 interconnecting the cylinder heads 29 and 30 and of communication passages 59, 60 in the nipple 52, to the fourth compression stage embodied by the cylinder 4.

The gas intaken in other compression chamber 34 on the inlet stroke of the piston 8 is compressed to a pressure of, for example, 180 bar on the delivery stroke and, with the outlet valve 37 open, supplied through the delivery line 51 to a gas fuel tank (not shown), for example, the fuel tank of a motor vehicle.

Disregarding any differences in the dimensions of the cooperating parts, all the delivery valves 37 and inlet valves 41 are virtually identical.

Referring to FIGS. 2–4 showing the outlet valve 37 of the cylinder 1, the valve 37 comprises a round discoid lid or disc 61 completely covering the associated passage 36 and a round resilient diaphragm 62 effective without attachment to engage the disc 61 with a plane abutment surface of a valve seat 63 which extends around the passage 36.

As illustrated in FIG. 2, the valve seat 63 is devised directly on the end plate 35 which bounds the compression chamber 31. On the side remote from the valve seat 63, the disc 61 has a central protuberance 64 which can take the form, for instance, of a cylindrical projection or, as shown, a frustum-shaped thickening of the disc 61. The protuberance 64 has an abutment on a side opposite the valve seat 63 and end plate 35.

The resilient diaphragm has a central thrust surface 66 abutting the abutment surface 65 of the protuberance 64 and is resiliently biased against the protuberance 64 to resiliently maintain the disc 61 in sealed relation with the valve seat 63. As illustrated, the diaphragm 62 is peripherally mounted in the retaining plate (guide part) 40 within the recess 38. To this end, the retaining plate 40 has a plurality of radially inwardly directed steps 67, as indicated in FIG. 3, supporting the outer periphery of the diaphragm 62 thereon. As indicated, the steps 67 are separated by local widenings 68 distributed around the periphery of the recess 38. The steps 67 extend over the valve seat 63 at a distance from the disc 61 sufficient for the disc 61 to disengage from the valve seat 63. Thus, the steps 67 are effective as abutments for a peripheral edge part 71 of the diaphragm which is urged into engagement with the steps 67. The widenings 68 ensure that with the outlet valve 37 open, there is a low-loss flow through the recess 38 of the gas issuing from the compression chamber 31. Of course, a different number of widenings or possibly only a single corresponding communicating orifice can be present.

Referring to FIG. 2, the abutment surface 65 of the protuberance 64 has a diameter from 12.5% to 25% of the diameter of the disc 61. The diaphragm 62 is made of, for example, spring steel and is of from 0.1 to 0.3 millimeters thick.

As can be gathered more particularly from FIG. 4, the diaphragm 62 is formed with three slots 70 offset from one another peripherally over the diaphragm surface. Each slot 70, starting from a reference position 72 on an annular edge part 71 of the diaphragm 62, extends in a spiral substantially over the four quadrants A, B, C, D of the surface of the diaphragm 62 towards the central thrust surface thereof. The thrust surface 66, which corresponds to the abutment surface 65 of the protuberance 64, is bounded by an imaginary circle inscribed between the inner ends 73 of the three slots 70. Each slot 70, starting from the respective reference position 72, has an initial part E which extends along the edge part 71 with a width increasing near the first quadrant A towards the second quadrant B and decreasing at the start thereof; a central part F which extends over the remainder of the second quadrant B and substantially over the third quadrant C with a reduced and substantially constant width; and a terminal part G which extends over the fourth quadrant D with a width increasing towards the thrust surface 66.

The slots 70 are so devised so as to have webs 74 between them. Each web 74 is of a width H which, starting from the edge part 71, experiences a continuous and minor reduction over the first half length and a continuous and reduced increase over the second half length towards the central thrust surface 66. The trust surface 66 can be devoid of an aperture and therefore, like the corresponding abutment surface 65 of the protuberance 64, be relatively small. With this construction, therefore, the material of the diaphragm 62 is used optimally and the webs 74 are relatively long and stressed satisfactorily and permit a relatively long spring travel with a diaphragm 62 of reduced diameter. Consequently, minimum dead space is combined with maximum deflection of the diaphragm 62 and so the constructional dimensions of the compressor can be correspondingly small.

The valve arrangement is suitable particularly for small dry compressors. The disc 61 and diaphragm 62 can have, for example, diameters of from approximately 10 to 12 millimeters (mm). The diaphragm 62 can be made of spring steel or some other material suitable for spring strips such as titanium or beryllium and each be from 0.1 to 0.3 mm thick. Constructions having dimensions other than those described are of course possible. The discs 61 can be made of metal or plastics, for example, polyether etherketone (PEEK). In association with the diaphragm 62 hereinbefore described and more particularly because of the plastics construction, a low-cost lightweight and quiet valve arrangement can be provided which responds rapidly and which operates with very reduced wear and correspondingly long life. An optimal ratio between maximum deflecting and the spring force of the diaphragm 62 can be provided in constructions in which the abutment surface 65 on the protuberance 64 and the central thrust surface 66 of the diaphragm 62 have a diameter corresponding approximately to from 25% to 12.5% of the diameter of the lid 61.

Variants can have discs each having a conical or lenticular abutment surface and cooperating with correspondingly devised seals. Another possibility is for the valve seat to be present on a replaceable insert.

The valve arrangement is not limited to compressors of the kind hereinbefore described and illustrated but is also of use for other purpose, for example, for rescuscitators, conduits, compressors for cryology or compressors for compressing $CO_2$, nitrogen and similar agents. The valve arrangement may also be used in pumps and conduits for liquid agents, such as water or liquid gas.

The invention thus provides a valve arrangement which can be readily incorporated into compressors within a reduced compact space.

Further, the invention provides a valve arrangement of relatively simple construction wherein the disc and diaphragm are of flat construction and which are not physically attached to each other. As such, the valve arrangement can be readily assembled and disassembled.

What is claimed is:

1. A reciprocating compressor comprising
at least one cylinder;
a piston slidably mounted in said cylinder to define a compression chamber therewith;
an inlet valve communicating with said chamber to deliver a flow of medium thereto for compression therein; and
an outlet valve communicating with said chamber to exhaust a compressed flow of medium therefrom;
each said valve including a first body having a first flow passage for a flow of medium, a valve seat at one end of said passage, a second body having a recess facing said first flow passage, said second body having a second flow passage extending from said recess, a disc in said recess abutting said valve seat and extending across said first flow passage, said disc having a centrally disposed protuberance defining an abutment surface on a side opposite said first flow passage, and a round resilient diaphragm mounted in said recess and having a central thrust surface resiliently biased against said protuberance to resiliently maintain said disc in sealed relation with said valve seat.

2. A reciprocating compressor as set forth in claim 1 wherein said first flow passage of said inlet valve is disposed in said piston.

3. A reciprocating compressor as set forth in claim 2 which further comprises a retaining plate secured to said piston and having said recess, said disc and said diaphragm therein.

4. A reciprocating compressor as set forth in claim 1 wherein said outlet valve is disposed in an end plate of said cylinder.

5. A reciprocating compressor as set forth in claim 1 wherein said disc is made of polyether etherketone.

6. A reciprocating compressor as set forth in claim 1 wherein said recess has at least one local widening on a periphery thereof.

* * * * *

UNITED STATES PATENT AND TRADEMARK OFFICE

CERTIFICATE OF CORRECTION

PATENT NO. : 4,981,421

DATED : January 1, 1991

INVENTOR(S) : Baumann, Heinz

It is certified that error appears in the above-identified patent and that said Letters Patent is hereby corrected as shown below:

Column 1, line 52 change "ba" to -be-
Column 2, line 11 change "seat" to -seat.-
Column 4, line 11 change "cf" to -of-
Column 5, line 2 change "from" to -of from-

Signed and Sealed this

Twenty-first Day of July, 1992

*Attest:*

DOUGLAS B. COMER

*Attesting Officer*

*Acting Commissioner of Patents and Trademarks*